US005860240A

United States Patent [19]

Ball et al.

[11] Patent Number: 5,860,240

[45] **Date of Patent: *Jan. 19, 1999**

[54] LOCK-ACTION MUZZLE LOADER

[75] Inventors: Henry C. Ball, 1315 Fairmont, Greensboro, N.C. 27403; Millard C. Marion, 159 Wolfetrail Rd., Greensboro, N.C. 27406

[73] Assignees: Henry C. Ball; Millard C. Marion, both of Greensboro, N.C.

[ * ] Notice: The term of this patent shall not extend beyond the expiration date of Pat. No. 5,511,334.

[21] Appl. No.: 886,296

[22] Filed: Jul. 1, 1997

Related U.S. Application Data

[63] Continuation of Ser. No. 630,693, Apr. 12, 1996, Pat. No. 5,642,583, which is a continuation of Ser. No. 317,210, Oct. 3, 1994, Pat. No. 5,511,334.

[51] Int. Cl.[6] ..... F41C 9/08

[52] U.S. Cl. ..... 42/51

[58] Field of Search ..... 42/51, 77, 83

[56] References Cited

U.S. PATENT DOCUMENTS

| | | | |
|---|---|---|---|
| 4,700,499 | 10/1987 | Knight | 42/51 |
| 4,912,868 | 4/1990 | Thompson | 42/77 |
| 5,109,622 | 5/1992 | Etcheberria | 42/69 |
| 5,133,143 | 7/1992 | Knight | 42/51 |
| 5,408,776 | 4/1995 | Mahn et al. | 42/51 |
| 5,487,232 | 1/1996 | Osborne et al. | 42/51 |
| 5,511,334 | 4/1996 | Ball et al. | 42/51 |
| 5,642,583 | 7/1997 | Ball et al. | 42/51 |

*Primary Examiner*—Charles T. Jordan
*Assistant Examiner*—Christopher K. Montgomery
*Attorney, Agent, or Firm*—Rhodes Coats & Bennett, L.L.P.

[57] ABSTRACT

A muzzle-loading firearm having a breech loading receiver including a locking mechanism movable between an open position and a locked position; a barrel having a breech end engaging the receiver and a bore extending from the barrel's breech end; and a firing module receiving plug positioned within the barrel's breech, the plug including a chamber axially aligned with the barrel bore to receive an ejectable firing module having an igniter within a chamber.

4 Claims, 1 Drawing Sheet

LOCK-ACTION MUZZLE LOADER

This application is a continuation of prior U.S. application Ser. No. 08/630,693, filed on Apr. 12, 1996, issued as U.S. Pat. No. 5,642,583, which was a continuation application of prior U.S. application Ser. No. 08/317,210, filed on Oct. 3, 1994, issued as U.S. Pat. No. 5,511,334.

BACKGROUND OF THE INVENTION (1) Field of the Invention

The present invention relates generally to firearms and, more particularly, to a lock-action, muzzle loader firearm.

(2) Description of the Prior Art

Modern breech-loading firearms, such as rifles, include a barrel having an axial bore, a stock to support the barrel, and a receiver at the breech end of the barrel. The receiver is comprised of a housing which includes a chamber for insertion of a cartridge into the breech of the barrel, a means for firmly securing the cartridge in the breech of the barrel in a sealed and locked position, a firing pin to discharge the cartridge primer, a trigger to move the firing pin into engagement with the cartridge primer, and an ejector to remove the cartridge after firing.

Muzzle-loading rifles and other muzzle-loading firearms are also comprised of a barrel with an axial bore and a supporting stock. However, a muzzle-loading rifle is loaded by inserting a charge of powder, wadding and shot through the muzzle end of the barrel and tamping the charge securely into the breech end of the barrel. The powder is then ignited, e.g., by striking a percussion cap, which sends a flame, normally through a small opening or flame bore, into the breech of the barrel.

Muzzle-loading rifles have several disadvantages in comparison with breech-loading cartridge rifles. They are more difficult and time consuming to load, and require greater skill to use. Malfunctions are more common due to the relatively more complex firing mechanisms required to ignite the powder. Moreover, existing muzzle-loading rifles are only capable of firing black powder, since the mechanisms will not withstand the pressure created by discharge of the more modern smokeless powder. Also, when a conventional muzzle-loader is fired, a cloud of sight obscuring, black smoke is emitted. Finally, since there is a significant lag time after the trigger of a muzzle-loading rifle is pulled until the weapon fires, it is extremely difficult to hit a moving target.

Despite these disadvantages, many hunters and firearms enthusiasts prefer to use muzzle-loading firearms, at least on some occasions, due to the nostalgia and the sport which the muzzle-loaders afford. In addition, many states allow a longer hunting season and special hunting areas for muzzle-loading firearms, due to the greater challenge provided and, consequently, the much smaller number of animals taken. Many users would prefer to have the advantages and enjoyment of a muzzle-loading weapon, however, without the attendant disadvantages.

Various designs have been proposed for the construction of improved muzzle-loading rifles. For example, U.S. Pat. No. 4,700,499 to Knight discloses a muzzle loading rifle that uses a "nut cracker" type of action to fire a conventional percussion cap. This design is said to eliminate or reduce the danger of flash-back which may occur in a muzzle loader. The Knight construction does not allow the use of a modern primer, however, nor the use of smokeless powders since chambers pressures would be too high for the conventional percussion cap and conventional muzzle-loading construction to withstand.

U.S. Pat. No. 3,780,464 to Anderson and U.S. Pat. No. 4,283,874 to Vaughan disclose mechanisms for replacing the flash hole structure in breech or muzzle loading firearms to allow firing with modern metallic cartridge primers. Both inventions use a cap covering to hold the primer in place until firing.

U.S. Pat. Nos. 4,227,330 and 4,232,468 to Chapin disclose a conversion plug that can be configured to be removably inserted into the breech of a breech loading firearm to convert the firearm into a muzzle loading type. The conversion plug includes a primer cap receiving chamber which communicates with the bore of the rifle through a flash hole. When used, a firing pin strikes the primer to ignite the powder in the barrel bore. The conversion plug remains in the bore, while the spent primer cap is replaced.

U.S. Pat. Nos. 4,222,191 to Lee et al; 4,437,249 to Brown et al; and 5,010,677 to Carron all disclose variations of the Chapin type of conversion plug for converting a shotgun or rifle into a muzzle loader.

None of these designs, however, provide the simplicity and reliability of the modern breech lock firearm, and none enable the user to load the rifle with modern smokeless powder. For example, no provision is made for ready removal and replacement of the percussion cap or primer cap. Also, the prior art does not disclose any way to convert a modern breech lock, cartridge rifle into a rifle that can be used as a muzzle-loading rifle with both black and smokeless powder.

Thus, there remains a need for a new and improved muzzle-loading rifle which can be easily primed for firing, and the primer cap readily removed after firing while, at the same time, utilizing the existing locking and firing mechanisms of modern breech loading firearms. Such a firearm would be able to fire both black powder and smokeless powder which generates substantially higher chamber pressures. Furthermore, such a fire arm would provide a means for converting a conventional, modern breech loading, cartridge firearm to a muzzle-loading firearm, while retaining the advantages of the breech loading firearm.

SUMMARY OF THE INVENTION

The present invention is directed to a lock-action muzzle loader which is achieved by modifying the design of a conventional breech loading firearm by plugging the breech end of the firearm's barrel with a specially designed plug which permits loading of the firearm as a muzzle-loader, while also permitting an igniter of a design described hereinafter to be inserted and ejected like a cartridge in a conventional breech loading firearm. The present invention takes advantage of the structural strength of a modern breech loading firearm to allow the use of smokeless powder, as well as black powder.

Thus, the muzzle-loading rifle of the present invention is comprised of a barrel into which powder, wadding and ball are loaded through the muzzle or discharge end in a conventional manner, a breech loading receiver attached to the breech or rear end of the barrel, and a breech plug within the breech end of the barrel adapted to receive a firing module having the shape of a conventional cartridge.

The receiver of the present invention may be of a variety of designs used in modern rifles, and may be a bolt action, a lever action, a rolling block or a semi-automatic design. In either case, the receiver will be comprised of a housing, a locking mechanism movable between an open position and a closed and locked position, a firing pin, a firing mechanism to strike the firing pin, and an ejector designed to eject a spent cartridge after firing. The housing may be threaded to attach a barrel.

The barrel, may have external annular threads at its breech end for attachment to the receiver housing. In accordance with the present invention, the barrel is drilled and tapped at its breech end to form internal plug engaging threads to secure a breech plug.

The breech plug is comprised of a cylindrical rear section and an axially aligned and integral, cylindrical front section. The rear section, which is preferably of a larger diameter than the barrel bore, is externally threaded to engage the internal threads of the barrel bore. The front section has an external diameter equal to the internal diameter of the barrel bore, and is adapted to snugly fit within the barrel bore when the breech plug is threaded into the barrel breech. The rear face of the breech plug is perpendicular to the axis of the plug. The breech plug shape may also be modified to accommodate the particular configuration of the firearm being modified. For example, the face of the plug may need to be configured to receive the cartridge ejector.

A cylindrical firing module receiving plug axially aligned with the barrel bore, extends from the rear face of the breech plug. This module receiving plug is formed of a continuous interior cylindrical wall, terminating in a tapered or conical inner face, which tapers inwardly to mate with the firing module. The length of the chamber is sufficient to accommodate the firing module, with only the ejection rim of the module extending from the chamber. A flame bore is axially aligned with the module receiving plug and extends between and communicates with the module receiving plug and the barrel bore, providing a passageway for a flame to travel from the firing module within the chamber to the barrel bore, and thus ignite powder within the breech of the barrel. The flame bore tapers radially outwardly at its forward end to form a powder receiving chamber.

The firing module is comprised of a thick cylindrical wall surrounding a central, axially aligned flame bore having a uniform diameter. The firing module terminates at its rear end in a vertical rear face, and is tapered at its forward end to engage the tapered inner face of the module receiving plug. An annular shoulder extends around the periphery of the firing module proximate to the module's rear face to create a radial ejection flange or rim adjacent the rear face of the module. The overall length of the module will depend on the design of the particular firearm. An igniter receiving chamber is recessed into the rear face of the firing module and is axially aligned with the flame bore. The chamber is of a shape and dimension such that it will snugly hold a commercially available igniter, such as a primer cap or a percussion cap. An igniter is fitted snugly into the chamber.

Accordingly, one aspect of the present invention is to provide a muzzle-loading firearm. The firearm includes: (a) a breech loading receiver including a locking mechanism movable between an open position and a locked position; (b) a barrel having a breech end engaging the receiver and a bore extending from the breech end for receiving a powder charge; and (c) a firing module insertable within the breech end of the barrel, the module comprising an igniter chamber, an igniter within the chamber, and a flame bore extending from the igniter chamber toward the bore of the barrel.

Another aspect of the present invention is to provide a firing module for use in a muzzle-loading bolt-action firearm. The firing module includes: (a) a generally cylindrical body having a back end and a front end; (b) an igniter chamber at the back end of the body; and (c) an axially aligned flame bore extending from the igniter chamber to the front end of the body.

Still another aspect of the present invention is to provide a muzzle-loading firearm. The firearm includes: (a) a breech loading receiver including a locking mechanism movable between an open position and a locked position; (b) a barrel having a breech end engaging the receiver and a bore extending from the breech end for receiving a powder charge; (c) a firing module receiving plug within the breech of the barrel, the firing module including: (i) a generally cylindrical body having a back end and a front end; (ii) an igniter chamber at the back end of the body; and (iii) an axially aligned flame bore extending from the igniter chamber to the front end of the body; and (d) a firing module insertable within the module receiving plug within the breech end of the barrel, the module comprising an igniter chamber, an igniter within the chamber, and a flame bore extending from the igniter chamber toward the bore of the barrel.

These and other aspects of the present invention will become apparent to those skilled in the art after a reading of the following description of the preferred embodiment when considered with the drawings.

DESCRIPTION OF THE PREFERRED EMBODIMENTS

Figure 1:
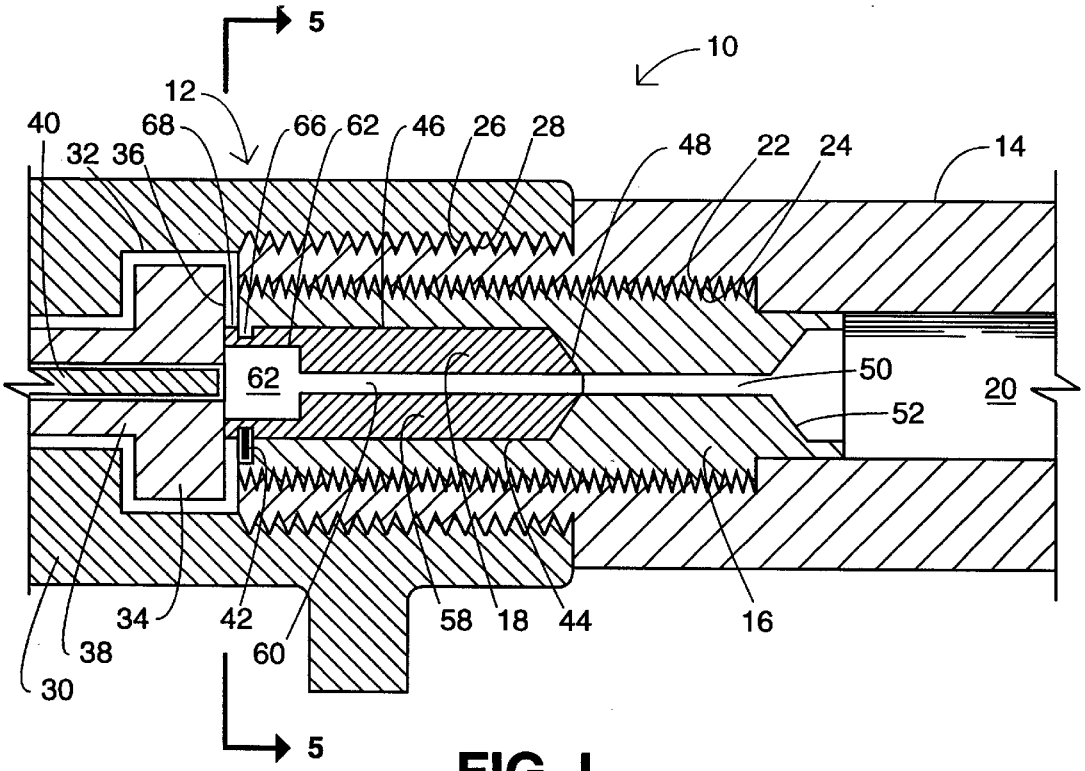
FIG. 1 is a top view of a rifle modified in accordance with the present invention loaded with the preferred firing module in locked position.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is shown a representation of a preferred embodiment of the present invention which is a rifle, generally 10, showing part of a receiver 12 and a barrel 14 of a conventional bolt action rifle which has been modified for muzzle-loading by plugging the breech of barrel 14 with a breech plug 16 adapted to receive a firing module 18 shown inserted into breech plug 16.

Barrel 14 includes a central axial bore 20 which extends from the breech end of barrel 14 to the muzzle or discharge end of the rifle. The breech end of barrel 14 is internally threaded with threads 22 to receive breech plug 16, which is externally threaded along a rear section with threads 24 which engage threads 22. The exterior surface of the breech end of barrel 14 is also threaded with threads 26 to engage an internally threaded opening 28 in receiver housing 30.

Receiver housing 30 also includes an bolt bore 32 axially aligned with barrel bore 20 to slidably receive a bolt 34 which is moveable between an open position and a closed and locked position. Bolt 34 includes a bolt face 36 and an axial bore 38 which slidably receives a firing pin 40. An ejector 42 is positioned in front of bolt 34.

Figure 5:
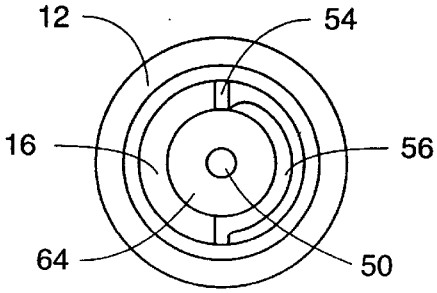
FIG. 5 is an end view of the breech plug taken along lines 5—5 in FIG. 1.

Breech plug 16 is comprised of a central, axially aligned, firing module receiving recess or chamber 44 formed of a cylindrical side wall 46 and an inwardly tapered front wall 48. Wall 48 is tapered to provide a larger surface for engagement with the forward end of module 18, thus producing a better seal. A central, axially aligned flame bore 50 extends from the center of front wall 48 to barrel bore 20, and terminates in an outwardly tapered front wall 52. The front section of plug 16 is of a diameter which permits it to be snugly inserted into bore 20 when plug 16 is threaded into barrel 14. The face of plug 16, best seen in FIG. 5, includes a radial slot 54 to facilitate insertion and removal of plug 16 into barrel 14, and an ejector receiving slot 56, which allows ejector 42 to engage module 18 for extraction.

Figure 2:
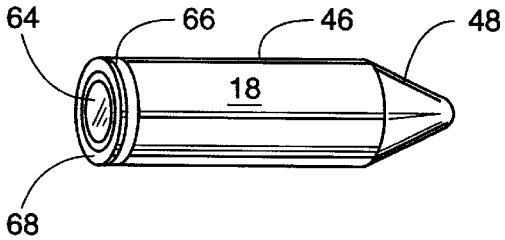
FIG. 2 is perspective view of the preferred firing modules with the primer cap removed.

The preferred firing module, shown in FIGS. 1 and 2, is comprised of a thick cylindrical wall 58 around a central, axially aligned, flame bore 60. An axially aligned igniter recess or chamber 62 extends inwardly from the breech end of module 18. Flame bore 60 extends from the inner face of igniter chamber 62 to flame bore 50 in plug 16, to form a flame passageway from igniter chamber 62 to barrel bore 20. Igniter chamber 62 is sized to snugly receive a primer cap 64, such as a conventional shotgun primer cap, and includes an annular shoulder to receive the annular rim of cap 64, so that the face of cap 64 is flush with the face of module 18. An annular shoulder 66 extends around module 18 to form a radial ejector flange 68.

Figure 3:
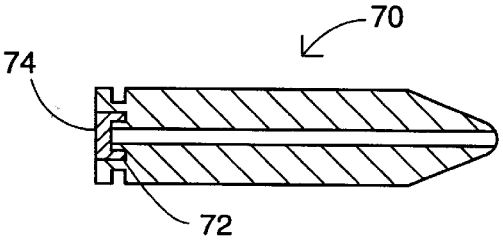
FIG. 3 is a side view of an alternative embodiment of the firing module using a percussion cap as the igniter.
Figure 4:
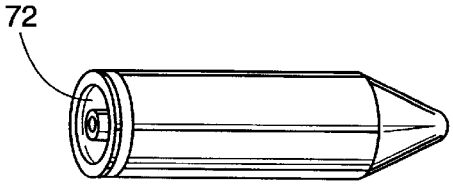
FIG. 4 is a perspective view of the alternative firing module shown in FIG. 3 with the percussion cap removed.

An alternative embodiment of the module 70 is shown in FIGS. 3 and 4. This alternative module differs from the preferred module 18 in that the igniter chamber is comprised of an annular shoulder 72, which is adapted to receive a conventional, low pressure percussion cap 74, such as is normally used in black powder firearms. This type of module is for use by hunters in areas where the law may require the use of low pressure percussion only.

In operation, the rifle is first loaded by inserted powder, wadding and shot into bore 20. The powder is tamped into the flared end 52 of flame bore 50. Then, for safety, module 18 is chambered into chamber 44 of plug 16 and bolt 34 is moved to the forward closed and locked position with bolt face 36 tightly in engagement with the rear face of module 18. The rifle is then fired in a conventional manner, e.g., by pulling a trigger, not shown, to bring the end of firing pin 40 into engagement with primer cap 64, producing a flame which travels through flames bores 60 and 50 to ignite the powder in bore 20, thereby propelling the bullet or shot from barrel 14. Spent module 18 is then ejected in the same manner as one would remove a spent cartridge from a modern breech loading cartridge rifle by withdrawing bolt 34 to open the receiver chamber and withdrawing module 18 from chamber 46 with ejector 42, which engages module 18 by moving into groove 18 and then moving rearwardly, pushing against ejector rim or flange 68. Module 70 can be used instead of module 18, and is fired and ejected in the same manner.

Certain modifications and improvements will occur to those skilled in the art upon a reading of the foregoing description. While the firearm of the present invention has been described in terms of the modification of an existing rifle, it will be apparent that the firearm or rifle can also be constructed initially in the described manner. Also, while a recessed flange such as used in most autoloading firearms has been shown, an extended flange such as used in revolvers and some rifles could also be used. The invention is also applicable to other breech loading, locking firearms, such as muzzle-loading handguns. It should be understood that all such modifications and improvements have been deleted herein for the sake of conciseness and readability but are properly within the scope of the follow claims.

We claim:

1. A firing module receiving plug for use in a muzzle-loading firearm, said firearm including a breech loading receiver including a locking mechanism movable between an open position and a locked position; a barrel having a breech end engaging said receiver and a bore extending from said breech end for receiving a powder charge; and a firing module, said firing module including: a generally cylindrical body having a back end and a front end, wherein the front end of said body forms a complementary seal with said firing module receiving plug; and an igniter chamber at the back end of said body, said firing module receiving plug comprising:

(a) a firing module receiving chamber axially aligned with the bore of said barrel, wherein said firing module is tapered at its forward end at a given angle and said module receiving plug is tapered at a complementary angle to said given angle at its forward end; and (b) a flame bore extending from said module receiving chamber to the bore of said barrel, wherein the tapered portion of the forward end extends inwardly to said flame bore.

2. The apparatus according to claim 1, wherein the flame bore of said plug expands outwardly at the barrel end to distribute the flame front into said powder charge.

3. The apparatus according to claim 1, wherein said module receiving plug is externally threaded along a part of its length and said barrel is internally threaded to receive said plug.

4. The apparatus according to claim 1, wherein said forward end of said module receiving plug has a circular cross section equal to the cross section of said barrel bore, said forward end extending into said barrel bore.

* * * * *